US010170253B2

(12) United States Patent
Liu

(10) Patent No.: US 10,170,253 B2
(45) Date of Patent: Jan. 1, 2019

(54) KEY SCISSOR-TYPE CONNECTING ELEMENT WITH AN ELASTIC CONTACT PART

(71) Applicant: Primax Electronics Ltd., Taipei (TW)

(72) Inventor: Chun-Yuan Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/790,187

(22) Filed: Oct. 23, 2017

(65) Prior Publication Data

US 2018/0308647 A1 Oct. 25, 2018

(30) Foreign Application Priority Data

Apr. 25, 2017 (TW) ..... 106113748 A

(51) Int. Cl.

| | |
|---|---|
| ***H01H 3/12*** | (2006.01) |
| ***H01H 13/14*** | (2006.01) |
| ***H01H 13/10*** | (2006.01) |
| ***H01H 3/60*** | (2006.01) |
| *H01H 13/52* | (2006.01) |

(52) U.S. Cl.
CPC ..... *H01H 13/14* (2013.01); *H01H 3/125* (2013.01); *H01H 3/60* (2013.01); *H01H 13/10* (2013.01); *H01H 2013/525* (2013.01)

(58) Field of Classification Search
CPC ..... H01H 3/125; H01H 3/60; H01H 2013/525
See application file for complete search history.

(56) References Cited

U.S. PATENT DOCUMENTS 6,257,782 B1 * 7/2001 Maruyama ..... H01H 3/125 200/344

* cited by examiner

*Primary Examiner* — Vanessa Girardi
(74) *Attorney, Agent, or Firm* — Kirton McConkie; Evan R. Witt

(57) ABSTRACT

A key structure includes a base plate, a triggering element, a keycap and a scissors-type connecting element. The base plate includes an open-type hook and a bulge. The scissors-type connecting element includes a first frame and a second frame. The first frame includes a first base post and an elastic contact part. Due to the structure of the open-type hook, the first frame can be easily assembled with the base plate. Moreover, it is not necessary to retain the gap between the first base posit and the open-type hook. While the first frame is swung, the elastic contact part is pushed by the corresponding bulge. Consequently, the first base post is not detached from the base plate.

9 Claims, 6 Drawing Sheets

KEY SCISSOR-TYPE CONNECTING ELEMENT WITH AN ELASTIC CONTACT PART

FIELD OF THE INVENTION

The present invention relates to a key structure, and more particularly to a key structure with a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. As known, a keyboard with scissors-type connecting elements is one of the widely-used keyboards.

Hereinafter, a key structure with a scissors-type connecting element of a conventional keyboard will be illustrated with reference to FIGS. 1 and 2. FIG. 1 is a schematic exploded view illustrating a conventional key structure. FIG. 2 is a schematic side cross-sectional view of the conventional key structure. As shown in FIGS. 1 and 2, the conventional key structure 1 comprises a keycap 11, a scissors-type connecting element 12, a rubbery elastomer 13, a membrane switch circuit member 14 and a metallic base plate 15. The keycap 11, the scissors-type connecting element 12 and the rubbery elastomer 13 are supported by the metallic base plate 15. The membrane switch circuit member 14 is disposed under the metallic base plate 15. The scissors-type connecting element 12 is used for connecting the metallic base plate 15 with the keycap 11. Consequently, the keycap 11 is movably fixed on the metallic plate 15. The metallic base plate 15 is made of a metallic material.

The membrane switch circuit member 14 comprises plural key intersections (not shown). When one of the plural key intersections is triggered, a corresponding key signal is generated. Consequently, a computer (not shown) in communication with the keyboard executes a command corresponding to the key signal. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The metallic base plate 15 comprises a base opening 151. The rubbery elastomer 13 is penetrated through the base opening 151 and disposed on the membrane switch circuit member 14. Moreover, the metallic base plate 15 further comprises a movable base hook 152 and a fixed base hook 153. The movable base hook 152 and the fixed base hook 153 are connected with the scissors-type connecting element 12. Similarly, the keycap 11 comprises a movable keycap hook 111 and a fixed keycap hook 112. The movable keycap hook 111 and the fixed keycap hook 112 are connected with the scissors-type connecting element 12.

The scissors-type connecting element 12 is arranged between the metallic base plate 15 and the keycap 11, and the metallic base plate 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the metallic base plate 15. The rubbery elastomer 13 is enclosed by the scissors-type connecting element 12, and arranged between the keycap 11 and the membrane switch circuit member 14. Moreover, the first frame 121 comprises a first keycap post 1211 and a first base post 1212. The first frame 121 is connected with the movable keycap hook 111 of the keycap 11 through the first keycap post 1211. The first frame 121 is connected with the fixed base hook 153 of the metallic base plate 15 through the first base post 1212. The second frame 122 is combined with the first frame 121. A first end of the second frame 122 is connected with the metallic base plate 15. A second end of the second frame 122 is connected with the keycap 11. Moreover, the second frame 122 comprises a second keycap post 1221 and a second base post 1222. The second frame 122 is connected with the fixed keycap hook 112 of the keycap 11 through the second keycap post 1221. The second frame 122 is connected with the movable base hook 152 of the metallic base plate 15 through the second base post 1222.

The operations of the conventional key structure 1 in response to the depressing action of the user will be illustrated as follows. Please refer to FIGS. 1 and 2 again. When the keycap 11 is depressed, the keycap 11 is moved downwardly to push the scissors-type connecting element 12 in response to the depressing force. As the keycap 11 is moved downwardly relative to the metallic base plate 15, the keycap 11 pushes the corresponding rubbery elastomer 13. At the same time, the rubbery elastomer 13 is subjected to deformation and penetrated through the base opening 151 to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

The above key structure is used in a keyboard module of a notebook computer. In comparison with the keyboard of a desktop computer, the keyboard module of the notebook computer is thinner and the keycap of the keyboard module is slimmer. Consequently, the keyboard module of the notebook computer is favored by many users. However, the conventional key structure 1 still has some drawbacks. For example, there is a gap g between the first base post 1212 and the fixed base hook 153. Due to the gap g, the first base post 1212 and the fixed base hook 153 can be assembled with each other more easily. However, the gap g may easily cause a rocked condition of the first frame 121. Under this circumstance, the overall stability of the conventional key structure 1 is adversely affected. Moreover, while the conventional key structure 1 is operated, the gap g may cause collision between the first base post 1212 and the fixed base hook 153. Under this circumstance, unpleasant noise is generated.

Therefore, there is a need of providing a key structure with increased stability and low noise.

SUMMARY OF THE INVENTION

The present invention provides a key structure with increased stability and low noise.

In accordance with an aspect of the present invention, there is provided a key structure. The key structure includes a base plate, a keycap and a scissors-type connecting element. The base plate includes a first open-type hook, a second open-type hook and a bulge. The keycap is disposed over the base plate and movable relative to the base plate. The scissors-type connecting element is connected with the keycap, the first open-type hook and the second open-type hook. While the scissors-type connecting element is swung, the keycap is moved relative to the base plate. The scissors-type connecting element includes a first frame and a second frame. The first frame has a first end connected with the keycap and a second end connected with the first open-type hook. The first frame includes a first base post and an elastic contact part. The first base post is located at a second end of the first frame and connected with the first open-type hook. The elastic contact part is located at the second end of the first frame and arranged beside the first base post. The elastic contact part is contacted with the bulge to prevent detachment of the first base post from the first open-type hook. The second frame is combined with the first frame. A first end of the second frame is connected with the second open-type hook. A second end of the second frame is connected with the keycap.

From the above descriptions, the present invention provides the key structure. The base plate of the key structure is equipped with the open-type hook and the bulge. The first frame of the scissors-type connecting element comprises the first base post and the elastic contact part corresponding to the bulge. Since the open-type hook is the non-closed hook, the first frame can be easily assembled with the base plate. Moreover, it is not necessary to retain the gap between the first base posit and the open-type hook. Consequently, the first frame is not rocked, and the stability of the keycap is enhanced. While the first frame is swung, the elastic contact part is pushed by the corresponding bulge. Consequently, the first base post is not detached from the base plate. Because of the open-type hook, the first base post and the open-type hook do not collide with each other while the first frame is swung. Consequently, the use of key structure can reduce noise from collision.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure.

Figure 1:
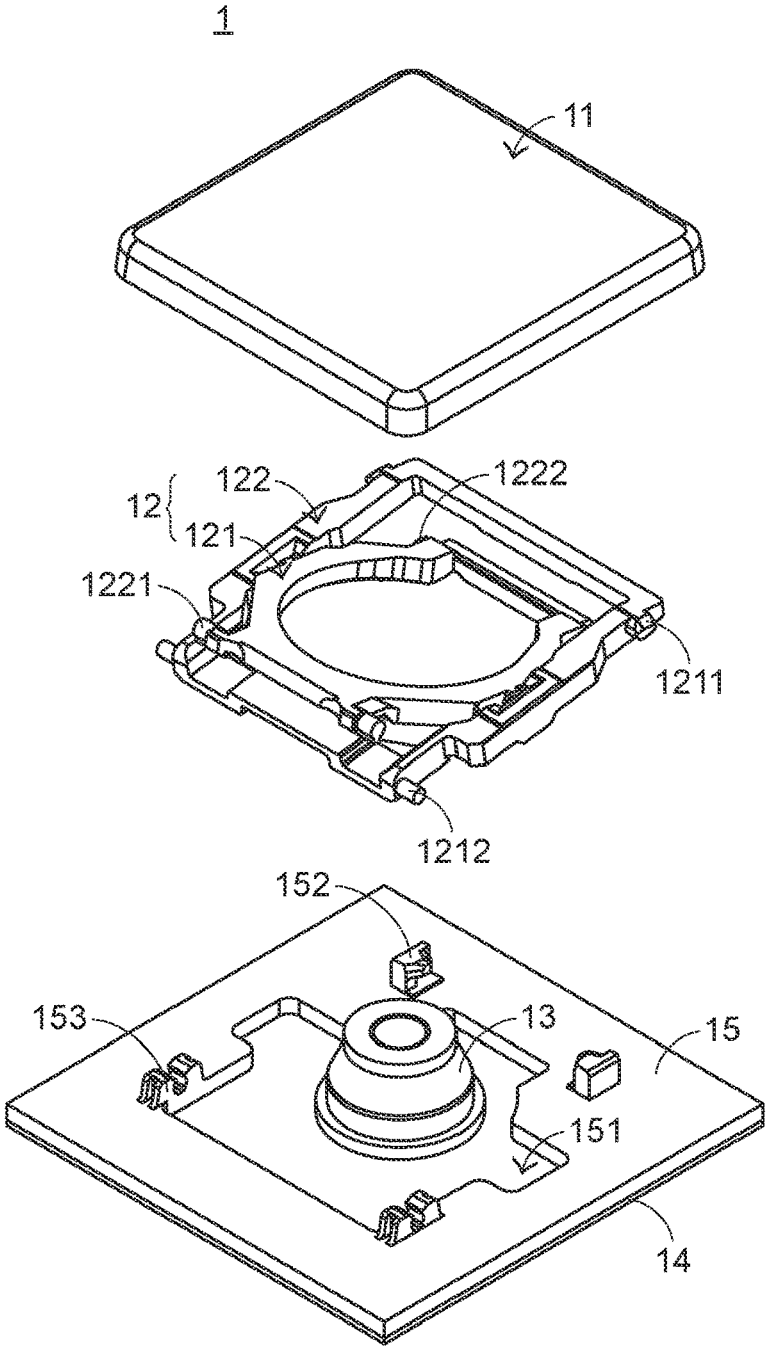
FIG.1 PRIOR ART
FIG. 1 is a schematic exploded view illustrating a conventional key structure.
Figure 2:
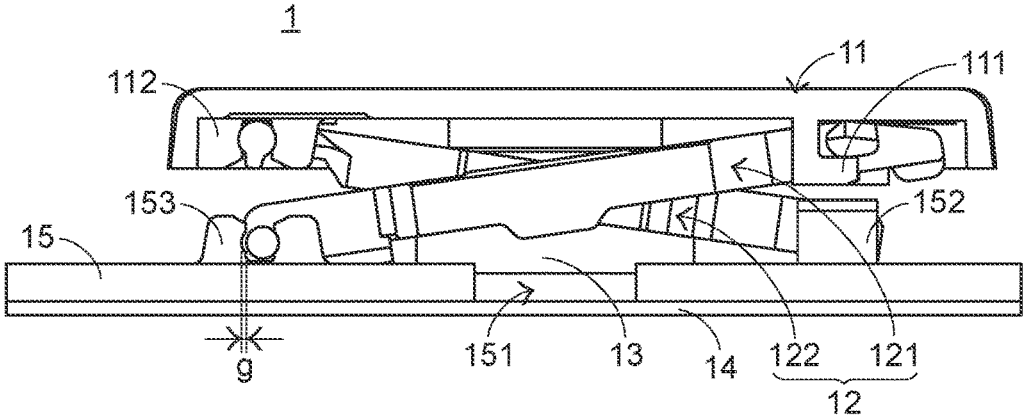
FIG.2 PRIOR ART
FIG. 2 is a schematic side cross-sectional view of the conventional key structure.
Figure 3:
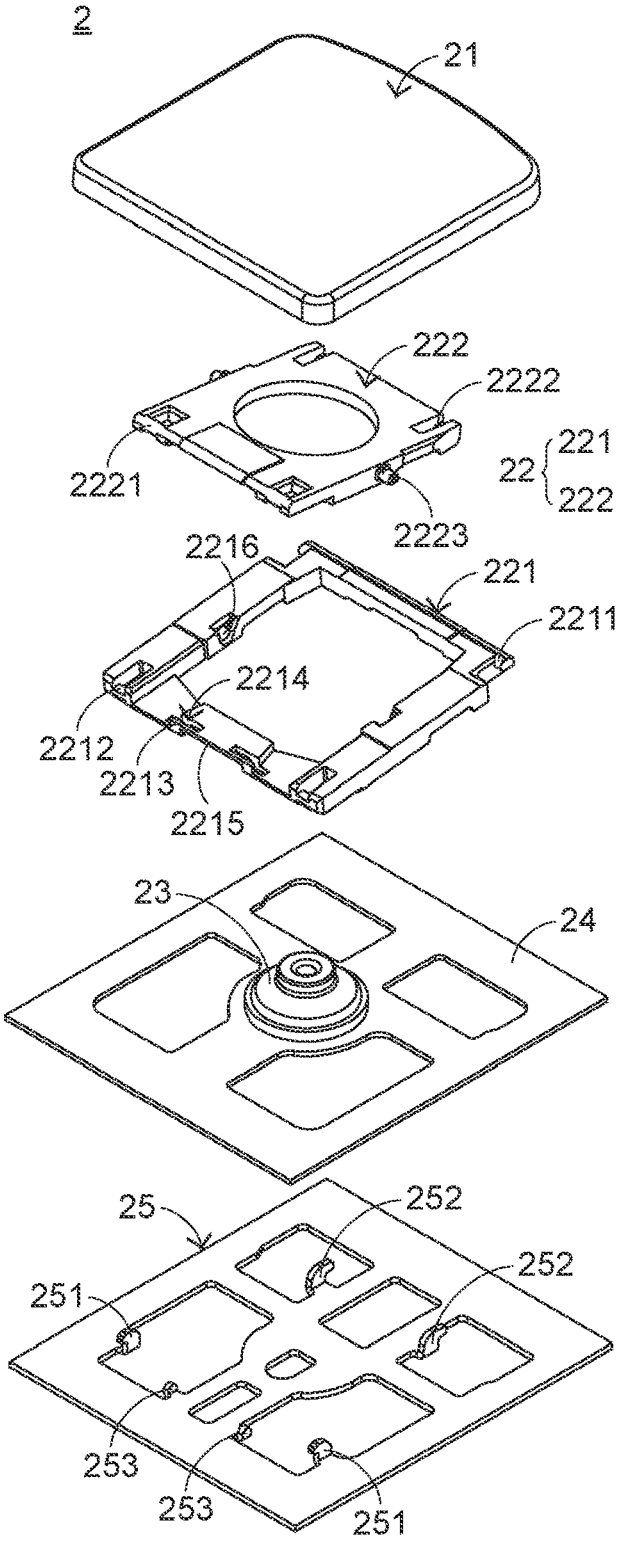
FIG. 3 is a schematic exploded view illustrating a key structure according to a first embodiment of the present invention.
Figure 4:
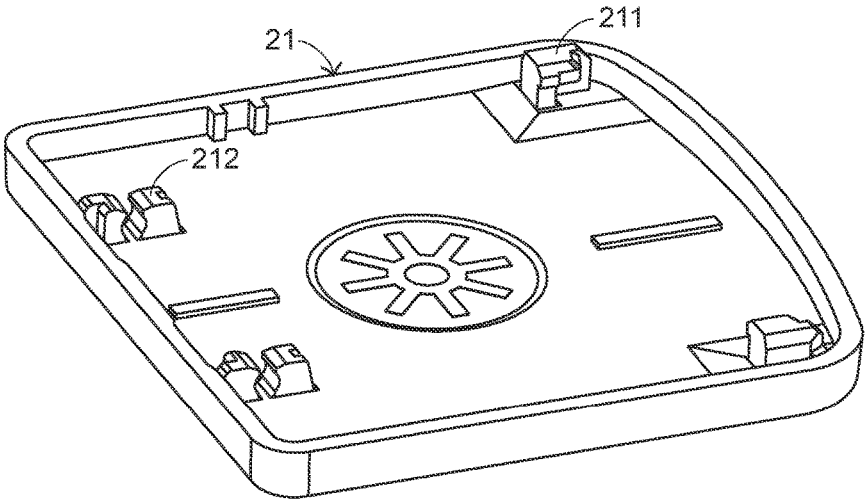
FIG. 4 is a schematic perspective view illustrating the keycap of the key structure according to the first embodiment of the present invention and taken along another viewpoint.

FIG. 3 is a schematic exploded view illustrating a key structure according to a first embodiment of the present invention. FIG. 4 is a schematic perspective view illustrating the keycap of the key structure according to the first embodiment of the present invention and taken along another viewpoint. As shown in FIGS. 3 and 4, the key structure 2 comprises a keycap 21, a scissors-type connecting element 22, a triggering element 23, a switch circuit board 24 and a base plate 25. The keycap 21, the scissors-type connecting element 22, the triggering element 23 and the switch circuit board 24 are supported by the base plate 25. The base plate 25 is connected with the keycap 21 through the scissors-type connecting element 22. As shown in FIG. 3, the components of the key structure 2 from top to bottom include the keycap 21, the scissors-type connecting element 22, the triggering element 23, the switch circuit board 24 and the base plate 25 sequentially. Moreover, the triggering element 23 is arranged between the keycap 21 and the switch circuit board 24 and enclosed by the scissors-type connecting element 22. The base plate 25 comprises plural first open-type hooks 251, plural second open-type hooks 252 and plural bulges 253. The plural first open-type hooks 251, the plural second open-type hooks 252 and the plural bulges 253 are bent structures that are protruded from the base plate 25. Moreover, the plural first open-type hooks 251, the plural second open-type hooks 252 and the plural bulges 253 are integrally formed with the base plate 25.

The switch circuit board 24 is disposed over the base plate 25. Moreover, the switch circuit board 24 is disposed under the triggering element 23 and contacted with the triggering element 23. The switch circuit board 24 has a key intersection (not shown) corresponding to the triggering element 23. The triggering element 23 is arranged between the keycap 21 and the base plate 25. When the triggering element 23 is pushed by the keycap 21, the triggering element 23 is subjected to deformation. Consequently, the key intersection of the switch circuit board 24 is triggered to generate a key signal by the triggering element 23. The keycap 21 is disposed over the triggering element 23. In response to an external force applied to the keycap 21, the keycap 21 is moved relative to the base plate 25 to push the triggering element 23. The scissors-type connecting element 22 is connected with the keycap 21 and the base plate 25. As the scissors-type connecting element 22 is swung, the keycap 21 is movable upwardly or downwardly relative to the base plate 25. In this embodiment, the triggering element 23 is a rubbery elastomer, and the switch circuit board 24 is a membrane switch circuit member over the base plate 25. It is noted that numerous modifications and alterations may be made while retaining the teachings of the invention. For example, in another embodiment, the switch circuit board is a membrane switch circuit member under the base plate, and base plate comprises a base opening for allowing the triggering element to penetrate through.

As shown in FIG. 4, the keycap 21 comprises plural movable hooks 211 and plural fixed hooks 212. The plural movable hooks 211 and the plural fixed hooks 212 are disposed on an inner surface of the keycap 21. The plural movable hooks 211 are located at a first side of the keycap 21, and the plural fixed hooks 212 are located at a second side of the keycap 21. In an embodiment, the plural movable hooks 211 and the plural fixed hooks 212 are integrally formed with the keycap 21.

Figure 5:
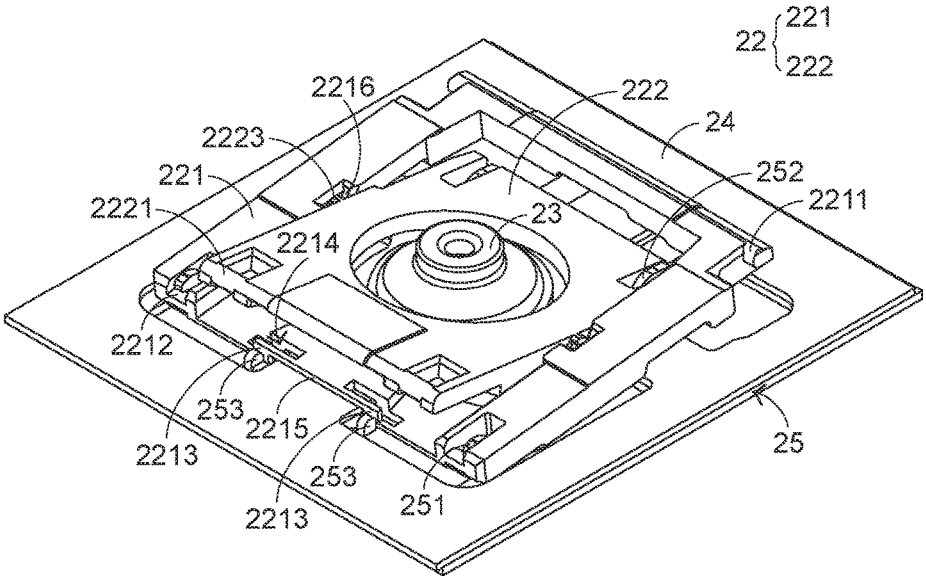
FIG. 5 is a schematic perspective view illustrating a portion of the key structure according to the first embodiment of the present invention.
Figure 6:
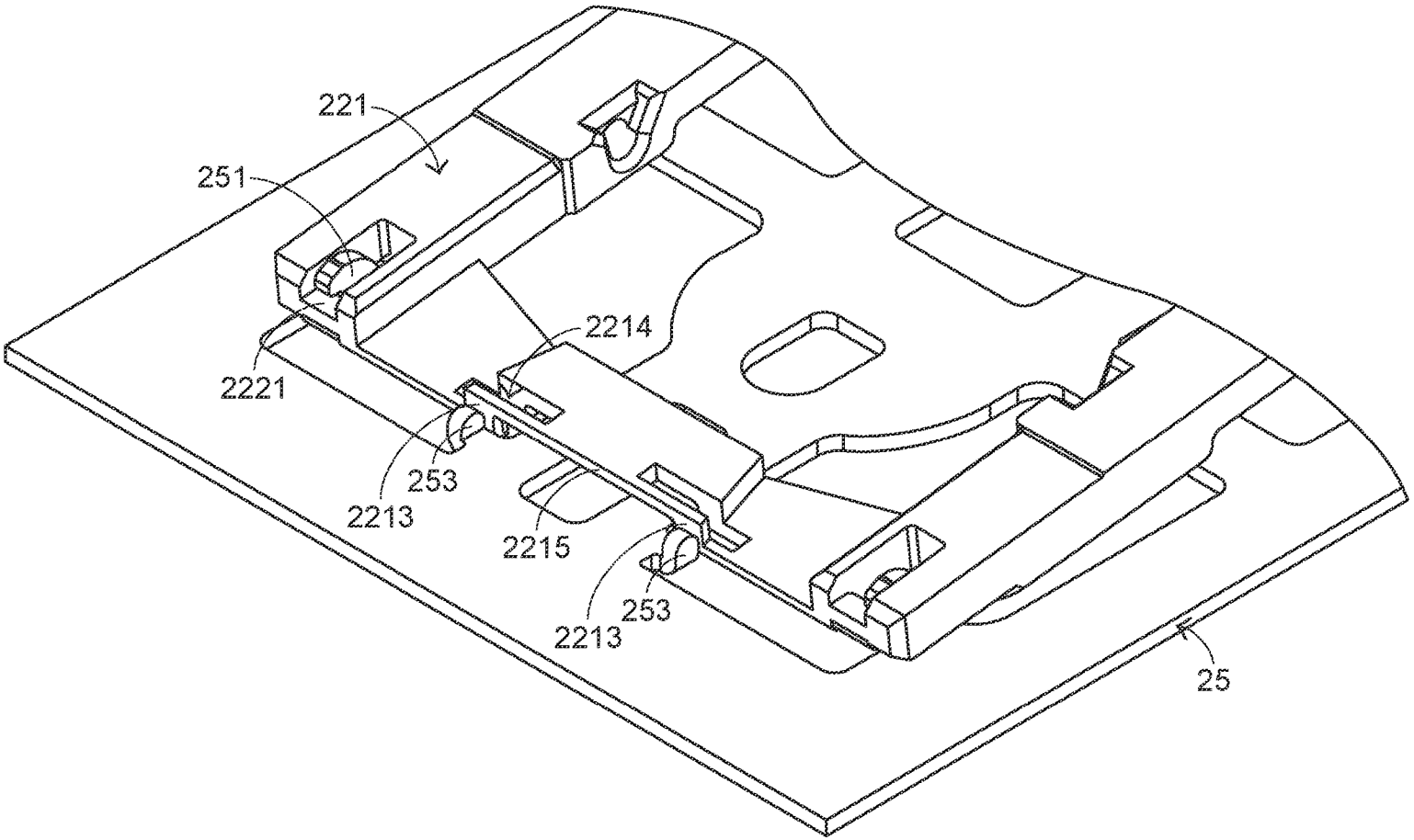
FIG. 6 is a schematic cutaway view illustrating the first frame and the base plate of the key structure according to the first embodiment of the present invention.

Hereinafter, the structure of the scissors-type connecting element 22 will be described with reference to FIGS. 3, 4, 5 and 6. FIG. 5 is a schematic perspective view illustrating a portion of the key structure according to the first embodiment of the present invention. FIG. 6 is a schematic cutaway view illustrating the first frame and the base plate of the key structure according to the first embodiment of the present invention. The scissors-type connecting element 22 comprises a first frame 221 and a second frame 222. A first end of the first frame 221 is connected with the plural movable hooks 211 of the keycap 21. A second end of the first frame 221 is connected with the plural first open-type hooks 251 of the base plate 25. Moreover, the first frame 221 comprises plural first keycap posts 2211, plural first base posts 2212, plural elastic contact parts 2213 and plural receiving parts 2214. The first keycap posts 2211 are located at the first end of the first frame 221 and connected with the corresponding movable hooks 211. The first base posts 2212 are located at the second end of the first frame 221 and connected with the corresponding first open-type hooks 251.

The elastic contact parts 2213 are also located at the second end of the first frame 221. Moreover, the elastic contact parts 2213 is arranged beside the first base posts 2212 and exposed to a sidewall 2215 of the first frame 221. The elastic contact parts 2213 are contactable with the corresponding bulges 253. When the elastic contact parts 2213 are contacted with the corresponding bulges 253, the first base posts 2212 are not detached from the corresponding first open-type hooks 251. The receiving parts 2214 are located at the second end of the first frame 221 and arranged near the corresponding elastic contact parts 2213. When the elastic contact parts 2213 are contacted with the corresponding bulges 253, the elastic contact parts 2213 are subjected to deformation in response to the contact force. The deformed portions of the elastic contact parts 2213 are accommodated within the receiving parts 2214. In this embodiment, the elastic contact parts 2213 are arranged along the sidewall 2215 of the first frame 221 to close the receiving parts 2214. Consequently, an opening is defined by the corresponding receiving part 2214.

The second frame 222 is combined with the first frame 221. A first end of the second frame 222 is connected with the plural second open-type hooks 252 of the base plate 25. A second end of the second frame 222 is connected with the plural fixed hooks 212 of the keycap 21. Moreover, the second frame 222 comprises plural second keycap posts 2221 and plural second base posts 2222. The second keycap posts 2221 are located at the second end of the second frame 222. The second keycap posts 2221 are connected with the corresponding fixed hooks 212. The second base posts 2222 are located at the first end of the second frame 222. The second base posts 2222 are connected with the corresponding second open-type hooks 252. As shown in FIG. 3, the first frame 221 further comprises two coupling recesses 2216, and the second frame 222 further comprises two rotating shafts 2223 corresponding to the coupling recesses 2216. The rotating shafts 2223 are disposed on lateral sides of the second frame 222. Moreover, the rotating shafts 2223 are in parallel with the second keycap posts 2221 and the second base posts 2222. The rotating shafts 2223 are inserted into the corresponding coupling recesses 2216, so that the first frame 221 and the second frame 222 are combined together. As the rotating shafts 2223 are rotated within the corresponding coupling recesses 2216, the first frame 221 is swung relative to the second frame 222 and the scissors-type connecting element 22 is activated. Moreover, while the keycap 21 is moved relative to the base plate 25, the scissors-type connecting element 22 is swung and the first keycap posts 2211 are slid within the corresponding movable hooks 211.

In this embodiment, the plural first keycap posts 2211, the plural first base posts 2212 and the plural elastic contact parts 2213 are integrally formed with the first frame 221, and the plural second keycap post 2221 and the plural second base post 2222 are integrally formed with the second frame 222.

After the above components are combined with each other, the key structure 2 as shown in FIG. 5 is assembled. The operations of the key structure 2 in response to the depressing action of the user will be illustrated as follows. When the keycap 21 is depressed by the user, the keycap 21 is moved downwardly to push the scissors-type connecting element 22 in response to the depressing force. Consequently, the scissors-type connecting element 22 is activated. As the keycap 21 is moved downwardly relative to the base plate 25 to push the triggering element 23, the triggering element 23 is subjected to deformation to push the switch circuit board 24 and trigger the corresponding key intersection of the switch circuit board 24. Consequently, the switch circuit board 24 generates a corresponding key signal. When the keycap 21 is no longer depressed by the user, no external force is applied to the keycap 21 and the triggering element 23 is no longer pushed by the keycap 21. In response to the elasticity of the triggering element 23, the triggering element 23 is restored to its original shape to provide an upward elastic restoring force. In response to the upward elastic restoring force, the keycap 21 is returned to its original position where it is not depressed.

In accordance with a feature of the present invention, the base plate 25 of the key structure 2 is equipped with the open-type hooks, i.e., non-closed hooks. Consequently, the process of assembling the first frame 221 and the second frame 222 with the base plate 25 is simplified. Moreover, due to arrangements of the plural elastic contact parts 2213 and the plural bulges 253, the elastic contact parts 2213 are pushed by the corresponding bulges 253 while the first frame 221 is swung. Consequently, the first base posts 2212 are not detached from the corresponding first open-type hooks 251. The second frame 222 further comprises the rotating shafts 2223 corresponding to the coupling recesses 2216. Due to the engagement between the rotating shafts 2223 and the coupling recesses 2216, the first frame 221 and the second frame 222 are combined together. Consequently, through the first frame 221, the second base posts 2222 of the second frame 222 are not detached from the corresponding second open-type hooks 252. The structures of the first frame 221, the second frame 222 and the base plate 25 are specially designed. Consequently, during the operation of the scissors-type connecting element 22, the first base posts 2212 and the corresponding first open-type hooks 251 do not collide with each other and the second base posts 2222 and the corresponding second open-type hooks 252 do not collide with each other. In other words, the use of key structure 2 can reduce noise from collision.

Figure 7:
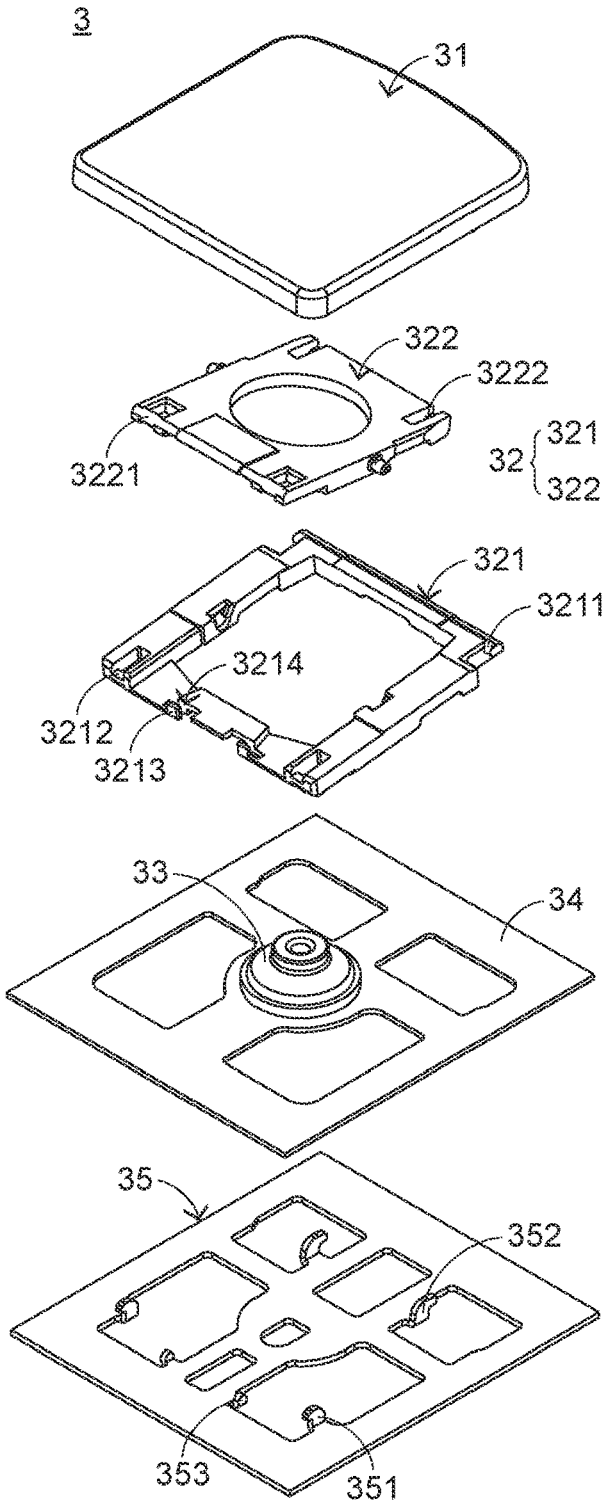
FIG. 7 is a schematic exploded view illustrating a key structure according to a second embodiment of the present invention.

The present invention further provides a second embodiment, which is distinguished from the first embodiment. FIG. 7 is a schematic exploded view illustrating a key structure according to a second embodiment of the present invention. As shown in FIG. 7, the key structure 3 comprises a keycap 31, a scissors-type connecting element 32, a triggering element 33, a switch circuit board 34 and a base plate 35. The base plate 35 comprises plural first open-type hooks 351, plural second open-type hooks 352 and plural bulges 353. The scissors-type connecting element 32 comprises a first frame 321 and a second frame 322. The first frame 321 comprises plural first keycap posts 3211, plural first base posts 3212, plural elastic contact parts 3213 and plural receiving parts 3214. The second frame 322 comprises plural second keycap posts 3221 and plural second base posts 3222. The structures and functions of the components of the key structure 3 which are identical to those of the first embodiment are not redundantly described herein. In comparison with the first embodiment, the structures of the elastic contact parts 3213 of this embodiment are distinguished.

In this embodiment, the elastic contact parts 3213 are partially inserted into the corresponding receiving parts 3214 to partially close the receiving parts 3214. Consequently, the receiving parts 3214 become concave spaces. In other words, the receiving parts 3214 are non-closed concave spaces. The appearance of the elastic contact part 3213 is different the appearance of the elastic contact parts of the above embodiment. However, the function of the elastic contact parts 3213 is similar to that of the above embodiment, and is not redundantly described herein.

From the above descriptions, the present invention provides the key structure. The base plate of the key structure is equipped with the open-type hook and the bulge. The first frame of the scissors-type connecting element comprises the first base post and the elastic contact part corresponding to the bulge. Since the open-type hook is the non-closed hook, the first frame can be easily assembled with the base plate. Moreover, it is not necessary to retain the gap between the first base posit and the open-type hook. Consequently, the first frame is not rocked, and the stability of the keycap is enhanced. While the first frame is swung, the elastic contact part is pushed by the corresponding bulge. Consequently, the first base post is not detached from the base plate. Because of the open-type hook, the first base post and the open-type hook do not collide with each other while the first frame is swung. Consequently, the use of key structure can reduce noise from collision.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate comprising a first open-type hook, a second open-type hook and a bulge;

a keycap disposed over the base plate and movable relative to the base plate; and a scissors-type connecting element connected with the keycap, the first open-type hook and the second open-type hook, wherein while the scissors-type connecting element is swung, the keycap is moved relative to the base plate, wherein the scissors-type connecting element comprises:

a first frame having a first end connected with the keycap and a second end connected with the first open-type hook, wherein the first frame comprises a first base post and an elastic contact part, wherein the first base post is located at a second end of the first frame and connected with the first open-type hook, the elastic contact part is located at the second end of the first frame and arranged beside the first base post, and the elastic contact part is contacted with the bulge to prevent detachment of the first base post from the first open-type hook, wherein the first frame further comprises a first keycap post, which is located at a first end of the first frame and connected with a movable hook of the keycap, wherein while the keycap is moved relative to the base plate, the first keycap post is slid within the movable hooks; and a second frame combined with the first frame, wherein a first end of the second frame is connected with the second open-type hook, and a second end of the second frame is connected with the keycap.

2. The key structure according to claim 1, wherein the first open-type hook, the second open-type hook and the bulge are bent structures that are protruded from the base plate, and the first open-type hook, the second open-type hook and the bulge are integrally formed with the base plate.

3. The key structure according to claim 1, wherein the first base post, the first keycap post and the elastic contact part are integrally formed with the first frame.

4. The key structure according to claim 1, wherein the second frame further comprises:

a second keycap post located at the second end of the second frame, and connected with a fixed hook of the keycap; and a second base post located at the first end of the second frame, and connected with the second open-type hook of the base plate.

5. The key structure according to claim 1, further comprising:

a triggering element arranged between the keycap and the base plate, wherein when the triggering element is pushed by the keycap, the triggering element is subjected to deformation; and a switch circuit board arranged between the triggering element and the base plate, wherein when the triggering element is subjected to deformation, the switch circuit board is triggered by the triggering element, so that a key signal is generated.

6. The key structure according to claim 5, wherein the triggering element is a rubbery elastomer.

7. The key structure according to claim 1, wherein the first frame further comprises a receiving part, and the receiving part is located at second end of the first frame and arranged near the elastic contact part, wherein when the elastic contact part is contacted with the bulge, the elastic contact part is subjected to deformation in response to a contact force, so that a deformed portion of the elastic contact part is accommodated within the receiving part.

8. The key structure according to claim 7, wherein the receiving part is closed by the elastic contact part, so that an opening is defined by the receiving part.

9. The key structure according to claim 7, wherein the elastic contact part is partially inserted into the receiving part to partially close the receiving part, so that the receiving part is formed as a concave space.

* * * * *